US011320188B2

(12) United States Patent
Avhale et al.

(10) Patent No.: US 11,320,188 B2
(45) Date of Patent: May 3, 2022

(54) BEVERAGE ZONE DUCT FOR TRIPLE EVAPORATOR REFRIGERATOR

(71) Applicant: WHIRLPOOL CORPORATION, Benton Harbor, MI (US)

(72) Inventors: Amit A. Avhale, St. Joseph, MI (US); Taylor Clark, St. Joseph, MI (US); Benjamin G. Jimenez, Burns Harbor, IN (US); E. Calvin Pickles, St. Joseph, MI (US); Richard Spletzer, St. Joseph, MI (US); David Walter, Cleveland, TN (US); Yan Zhang, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 128 days.

(21) Appl. No.: 16/226,967

(22) Filed: Dec. 20, 2018

(65) Prior Publication Data

US 2019/0204002 A1 Jul. 4, 2019

Related U.S. Application Data

(60) Provisional application No. 62/611,725, filed on Dec. 29, 2017.

(51) Int. Cl.
*F25D 11/02* (2006.01)
*F25D 17/06* (2006.01)
(Continued)

(52) U.S. Cl.
CPC ..... *F25D 11/022* (2013.01); *F25D 17/062* (2013.01); *F25D 17/067* (2013.01);
(Continued)

(58) Field of Classification Search
CPC ..... F25D 17/08; F25D 2317/062
See application file for complete search history.

(56) References Cited

U.S. PATENT DOCUMENTS 4,368,622 A * 1/1983 Brooks ..... F25D 17/062 62/157
5,097,675 A 3/1992 Elsom et al.
(Continued)

FOREIGN PATENT DOCUMENTS

EP 3163231 A1 3/2017
EP 3211354 A2 8/2017

OTHER PUBLICATIONS

European Search Report dated May 8, 2019 in Co-Pending EP Application No. 18214600.1-1009.

*Primary Examiner* — Christopher R Zerphey
(74) *Attorney, Agent, or Firm* — Price Heneveld LLP

(57) ABSTRACT

A refrigerator includes an outer wrapper, a fresh food compartment defined by a liner within the wrapper and separated from an interior of the outer wrapper at least along a first side wall of the fresh food compartment to define a void, and a door at least partially enclosing an opening to the fresh food compartment when in a closed position. A door compartment is positioned along the door. The refrigerator further includes an evaporator compartment positioned at least partially within the fresh food compartment and a duct in fluid communication with the evaporator compartment at a first end thereof and in communication with the door compartment a second end thereof. The duct has a first portion that extends laterally from the first end along a portion of the evaporator compartment and a second portion extending through the void along the first side wall of the fresh food compartment.

20 Claims, 6 Drawing Sheets

(51) Int. Cl.

| | |
|---|---|
| ***F25D 17/08*** | (2006.01) |
| ***F25D 23/02*** | (2006.01) |
| ***F25D 23/06*** | (2006.01) |
| ***F25D 23/00*** | (2006.01) |

(52) U.S. Cl.

CPC ..... *F25D 17/08* (2013.01); *F25D 23/006* (2013.01); *F25D 23/028* (2013.01); *F25D 23/069* (2013.01); *F25D 2317/062* (2013.01); *F25D 2317/0671* (2013.01)

(56) References Cited

U.S. PATENT DOCUMENTS

| | | | | |
|---|---|---|---|---|
| 5,927,095 | A * | 7/1999 | Lee | F25D 17/062 62/273 |
| 5,946,934 | A | 9/1999 | Kim et al. | |
| 6,983,615 | B2 | 1/2006 | Winders et al. | |
| 7,093,453 | B2 * | 8/2006 | Asan | F25D 17/065 62/186 |
| 7,775,065 | B2 | 8/2010 | Ouseph et al. | |
| 7,866,182 | B2 * | 1/2011 | Lim | F25D 17/062 62/418 |
| 8,601,830 | B2 | 12/2013 | Lee et al. | |
| 8,770,682 | B2 | 7/2014 | Lee et al. | |
| 9,010,145 | B2 | 4/2015 | Lim et al. | |
| 9,097,454 | B2 * | 8/2015 | LeClear | F25D 23/069 |
| 9,140,472 | B2 | 9/2015 | Shin et al. | |
| 9,857,122 | B2 * | 1/2018 | Im | F25D 23/02 |
| 10,240,851 | B2 * | 3/2019 | Kim | F25D 11/022 |
| 10,969,157 | B2 * | 4/2021 | Cheng | F25D 23/061 |
| 2008/0307823 | A1 | 12/2008 | Lee et al. | |
| 2010/0293983 | A1 * | 11/2010 | Kim | F25D 17/065 62/340 |
| 2013/0111941 | A1 | 5/2013 | Yu et al. | |
| 2015/0107285 | A1 | 4/2015 | Mitchell et al. | |
| 2019/0056165 | A1 * | 2/2019 | Im | F25D 23/025 |
| 2020/0124339 | A1 * | 4/2020 | Cheng | F25D 17/065 |

* cited by examiner

BEVERAGE ZONE DUCT FOR TRIPLE EVAPORATOR REFRIGERATOR

CROSS-REFERENCE TO RELATED APPLICATION

This application claims priority to and the benefit under 35 U.S.C. § 119(e) of U.S. Provisional Patent Application No. 62/611,725, filed on Dec. 29, 2017, entitled "BEVERAGE ZONE DUCT FOR TRIPLE EVAPORATOR REFRIGERATOR". The entire disclosure of which is hereby incorporated herein by reference.

BACKGROUND

The present device generally relates to a refrigerator having a chilled door compartment. In particular a duct extends from a dedicated fresh food compartment evaporator, through an interior of a side wall, and to the door compartment.

Various examples of refrigerators having cooled door compartments exist in which a cool air flow is directed through, for example, a wall of the refrigerator to the door. Such arrangements solve the problem of the forward portions of the refrigerator being generally warmer than the center of the cabinet but many consumers having a preference for storing beverages in the door. In most applications, such cooling is provided in single-evaporator refrigerators, where a common evaporator is used to cool both the freezer and refrigerator, with baffles or fans controlling the air flow to maintain the freezer at a temperature below that of the refrigerator. Even in existing refrigerators with a dedicated fresh food compartment evaporator and a dedicated freezer evaporator, air supplied to a chilled door compartment is taken from the freezer evaporator, which presents certain issues because the desired relative humidity level in the refrigerator exceeds that of the freezer, such that introducing humidity into the freezer air flow will increase frost risk in the freezer. Further, introducing a freezer air supply to the fresh food compartment will mix the relatively warm fresh food compartment and relatively cold freezer air flow such that the intended behavior of each compartment may be considered as adversely affected. Finally, additional energy expenditure would be required to maintain the desired temperature balance of the fresh food compartment contents, where energy margins are generally small and each increment of energy use may be costly. Accordingly, additional improvements may be desired.

SUMMARY

In at least one aspect, a refrigerator includes an outer wrapper, a fresh food compartment defined by a liner within the wrapper and separated from an interior of the outer wrapper at least along a first side wall of the fresh food compartment to define a void, and a door at least partially enclosing an opening to the fresh food compartment when in a closed position. A door compartment is positioned along the door. The refrigerator further includes an evaporator compartment positioned at least partially within the fresh food compartment and a duct in fluid communication with the evaporator compartment at a first end thereof and in communication with the door compartment a second end thereof. The duct has a first portion that extends laterally from the first end along a portion of the evaporator compartment and a second portion extending through the void along the first side wall of the fresh food compartment.

In at least another aspect, a refrigerator includes a door at least partially enclosing an opening to a fresh food compartment when in a closed position. A door compartment is positioned along the door. The refrigerator further includes an evaporator compartment positioned at least partially within the fresh food compartment and a duct in fluid communication with the evaporator compartment at a first end thereof and in communication with the door compartment a second end thereof. The duct has a first portion that extends laterally from the first end along a portion of the evaporator compartment and a second portion that extends from the first portion toward the opening of the fresh food compartment. The first portion of the duct is at least partially defined by a portion of the evaporator compartment.

In at least another aspect, a refrigerator includes an outer wrapper, a fresh food compartment defined by a liner within the wrapper and separated from an interior of the outer wrapper at least along a first side wall of the fresh food compartment to define a void, and a door at least partially enclosing an opening to the fresh food compartment when in a closed position. A door compartment is positioned along the door. The refrigerator further includes an evaporator compartment positioned at least partially within the fresh food compartment and a duct in fluid communication with the evaporator compartment at a first end thereof and in communication with the door compartment a second end thereof. The duct has at least a portion that extends through the void along the first side wall of the fresh food compartment. A vacuum-insulated layer extends at least partially along the portion of the duct between the duct and the wrapper.

These and other features, advantages, and objects of the present device will be further understood and appreciated by those skilled in the art upon studying the following specification, claims, and appended drawings.

DETAILED DESCRIPTION OF EMBODIMENTS

Figure 1:
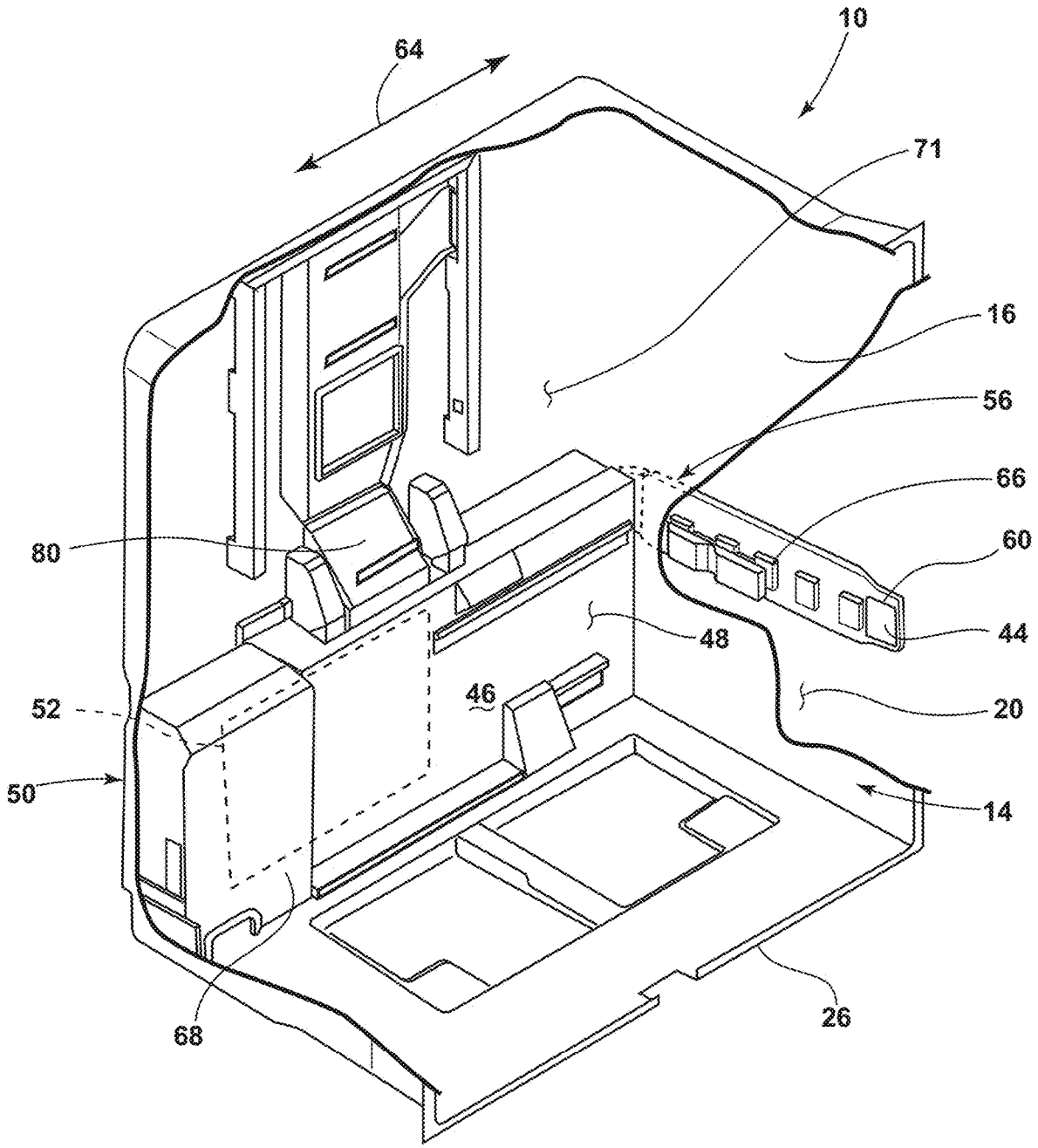
FIG. 1 is a perspective view of a refrigerator interior including a duct extending from an evaporator compartment to a door compartment.
Figure 2:
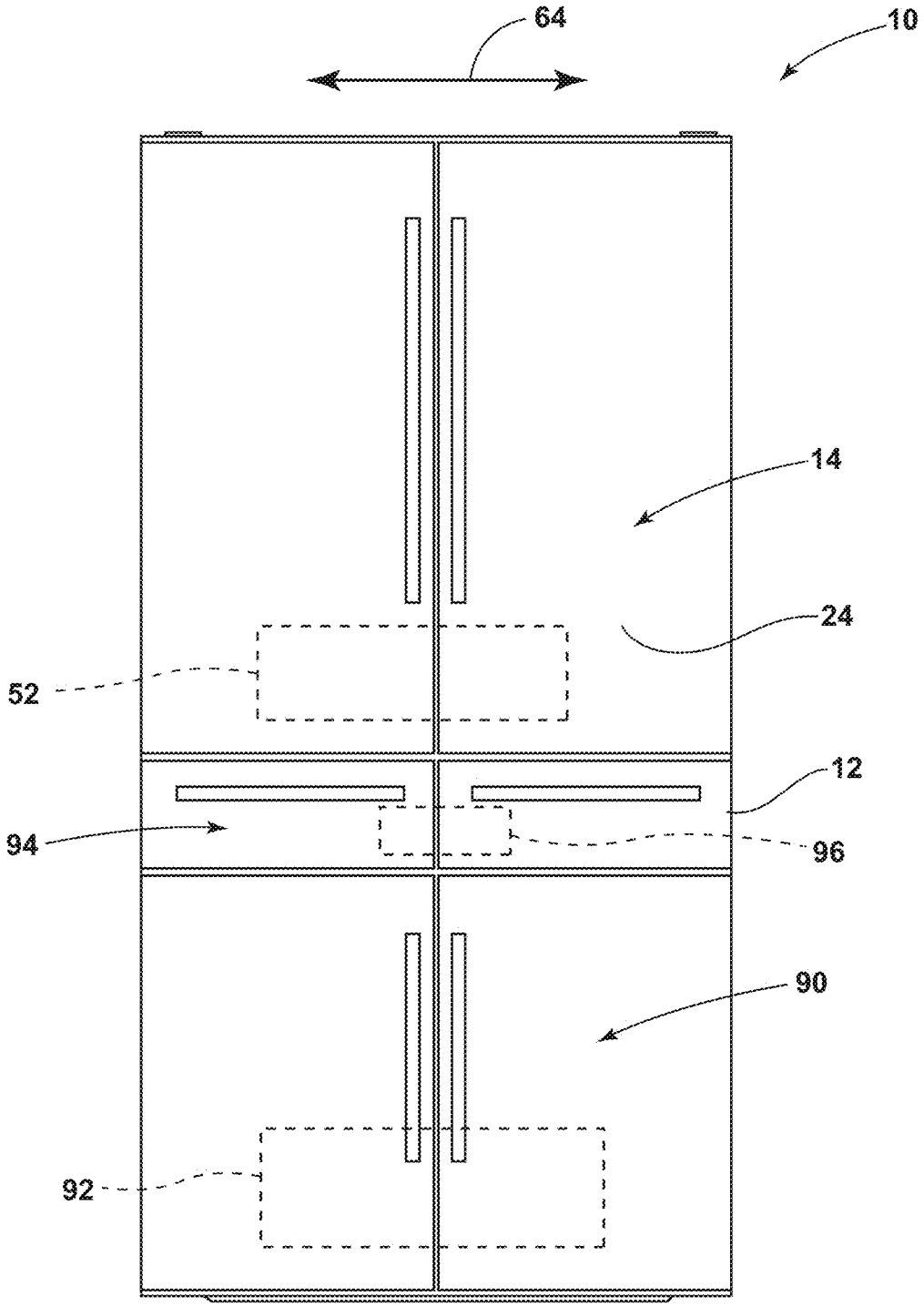
FIG. 2 is a front view of the refrigerator of FIG. 1.

For purposes of description herein the terms "upper," "lower," "right," "left," "rear," "front," "vertical," "horizontal," and derivatives thereof shall relate to the device as oriented in FIG. 1. However, it is to be understood that the device may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Referring to the embodiment illustrated in FIG. 1, reference numeral 10 generally designates a refrigerator. Refrigerator 10 includes an outer wrapper 12, a fresh food compartment 14 defined by a liner 16 within the wrapper and separated from an interior 18 of the outer wrapper at least along a first side wall 20 of the fresh food compartment 14 to define a void 22, and a door 24 at least partially enclosing an opening 26 to the fresh food compartment 14 when in a closed position. The door 24 defines a door dyke 28 extending inwardly within the fresh food compartment 14 around a periphery 40 of the door. A door compartment 42 is positioned along the door 24 with at least a portion of the dyke 28 adjacent to a portion of the compartment 42. A vent opening 34 extends through the dyke 28 and into the door compartment 42. The refrigerator 10 further includes an evaporator compartment 46 positioned at least partially within the fresh food compartment 14, defining an exterior 38 and an interior 40, and containing an evaporator 52 and a fan 54 for drawing chilled air away from the evaporator 52. A duct 56 is in fluid communication with the evaporator compartment 46 adjacent the fan 54 at a first end 58 thereof and in communication with the vent opening 44 on a second end 60 thereof such that the duct 56 directs chilled air from the evaporator compartment 46 to the door compartment 42. The duct 56 has a first portion 62 that extends in lateral direction 64 from the first end 58 along a portion of the evaporator compartment 46 and a second portion 66 extending through the void 22 along the first side 20 wall of the fresh food compartment 14.

Figure 3:
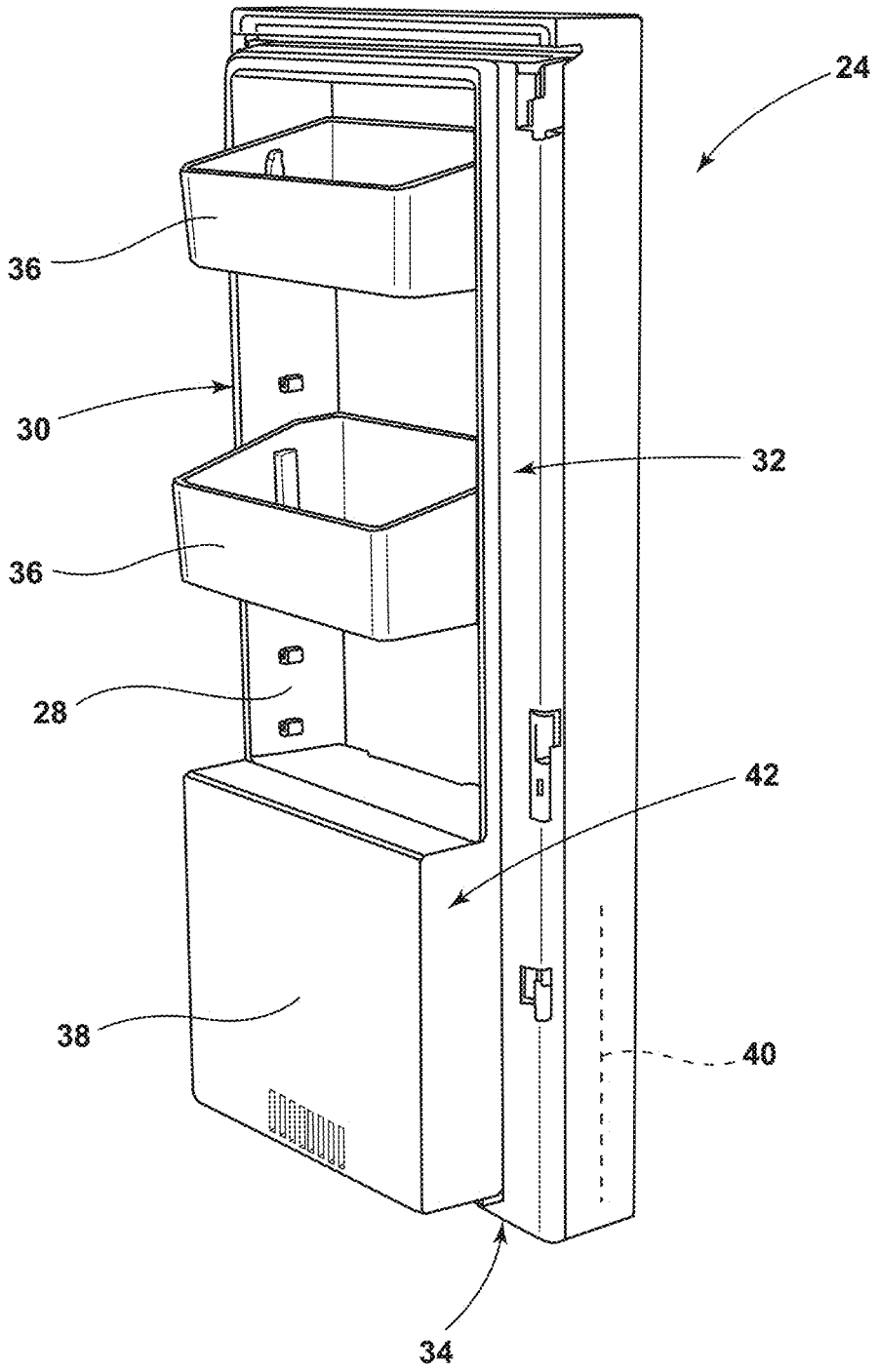
FIG. 3 is a perspective view of a door for the refrigerator of FIG. 1 including a chilled compartment therein in communication with the evaporator by way of the duct illustrated in FIG. 1.

In the illustrated embodiment, the door 24 is configured as a right door 24 in a French-door refrigerator 10 arrangement, in which a left door is also included with each of the right door 24 and the left door covering approximately half of the opening 26 to fresh food compartment 14, with each door being hingedly connected about or adjacent a corresponding outer edge of the outer wrapper 12 of refrigerator 10. In the depicted arrangement, as particularly shown in FIG. 3, the door compartment 42 is positioned along a lower portion of the right-side door 24 such that it is surrounded by opposing sides 30 and 32 of dyke 28 and is adjacent lower side 34 of dyke 28. Door compartment 42 extends only partially upward along door 24 such that additional bins 36 can also be positioned along door 24. Further, compartment 42 can, as illustrated, be an enclosed compartment accessible through a sub-door 38 facing inwardly on door compartment 42 so that door compartment 42 can be accessed by a user when door 24 is open. Additionally or alternatively, door 24 can be in a door-in-door configuration with an outer door (not shown) positioned opposite door compartment 42 and bins 36 so that door compartment 42 can be accessed from outside of refrigerator 10.

In this manner, duct 56 can provide a direct cool air supply of chilled air from the evaporator compartment 46 to the door compartment 42. In one example, the cool air supply can make door compartment 42 useable as a "beverage zone", such that the compartment 42 becomes colder than the center of the fresh food compartment 14. The fan 54 within evaporator compartment 46 accelerates air from upstream as it passes through the evaporator 52 and is cooled. Downstream from fan 54, the chilled air is distributed through a network of flow pathways, as discussed further below, to the interior of the fresh food compartment 14 in general and to an enclosed pantry or crisper (not shown) typically within a lower portion of fresh food compartment 14 and which may be partially isolated from the chilled air flow by way of a damper 72 within a pathway 74 directed to the pantry that can restrict the flow of chilled air thereinto to intentionally maintain the pantry temperature above the remaining portion of the fresh food compartment 14.

In general, the door 24 of the refrigerator 10 is susceptible to increased warming relative to the center of the fresh food compartment 14 interior due to its proximity to the exterior of the refrigerator 10 and its distance from the primary outlets of chilled air from evaporator compartment 46. However, because the door 24 is conveniently sized for beverage storage, and is generally easily accessible, additional cooling of at least a portion of door 24 may be desired to maintain perishable beverages (such as dairy products or the like) at a lower temperature, or to otherwise more quickly cool and maintain a low temperature of beverages. In this manner duct 56 has no damper such that it receives flow concurrently with the rest of the fresh food compartment 14 to maintain door compartment 42 at a lower temperature than would otherwise be obtainable.

Figure 5:
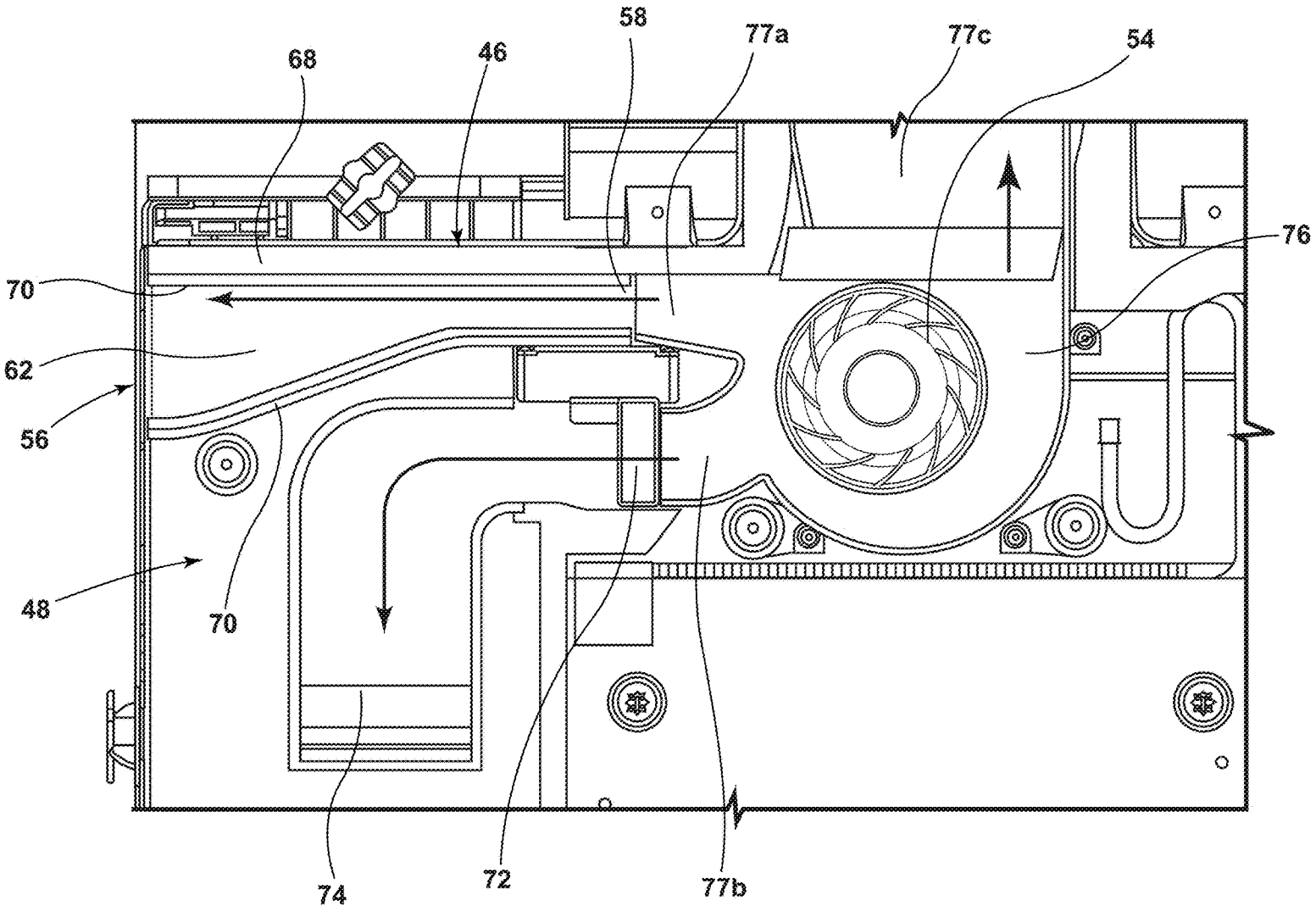
FIG. 5 is a back view of a portion of an interior of the refrigerator of FIG. 1 including a portion of the duct in communication with a fan shroud associated with the evaporator.

As shown in FIG. 1, evaporator compartment 46 is generally defined and separated from fresh food compartment 14 by a housing 68 that defines the exterior 48 and interior 50 surfaces thereof. As shown in FIG. 5, fan 54 is mounted within a shroud 76 within housing 68. A cosmetic outer cover may be positioned on the exterior 48 of housing 68 to provide a finished appearance for evaporator compartment 46. Housing 68 includes a primary outlet channel 78 therethrough that directs air from fan 54 into the fresh food compartment 14. An air tower 80 extends upward from evaporator compartment 46 along the rear wall of the fresh food compartment 14 and provides the primary flow of chilled air therefor. As shown in FIG. 5, the first end 58 of duct 56 is in communication with the interior 50 of the evaporator compartment 46 such that a portion of the chilled air is forced into duct 56 by fan 54. It can be seen that the first portion 62 of duct 56 extends laterally sideways in direction 64 along the exterior 48 of evaporator compartment 46, which positions first portion 62 of duct 56 inside housing 68 so that duct 56 is concealed from view. In various embodiments, housing 68 can be adapted to accommodate the position and/or packaging of first portion 62 of duct 56 within housing 68. In the example shown, portions (such as inner or outer portions) of first portion 62 is incorporated into housing 68 by way of ribs 70 that abut the back wall 71 of liner 16. As further illustrated, fan shroud 76 can include a number of outlets 77*a*,77*b*,77*c* therein to direct portions of air from fan 54 into first portion 62 of duct 56, as well as into pantry path 74 or into air tower 80.

Figure 4:
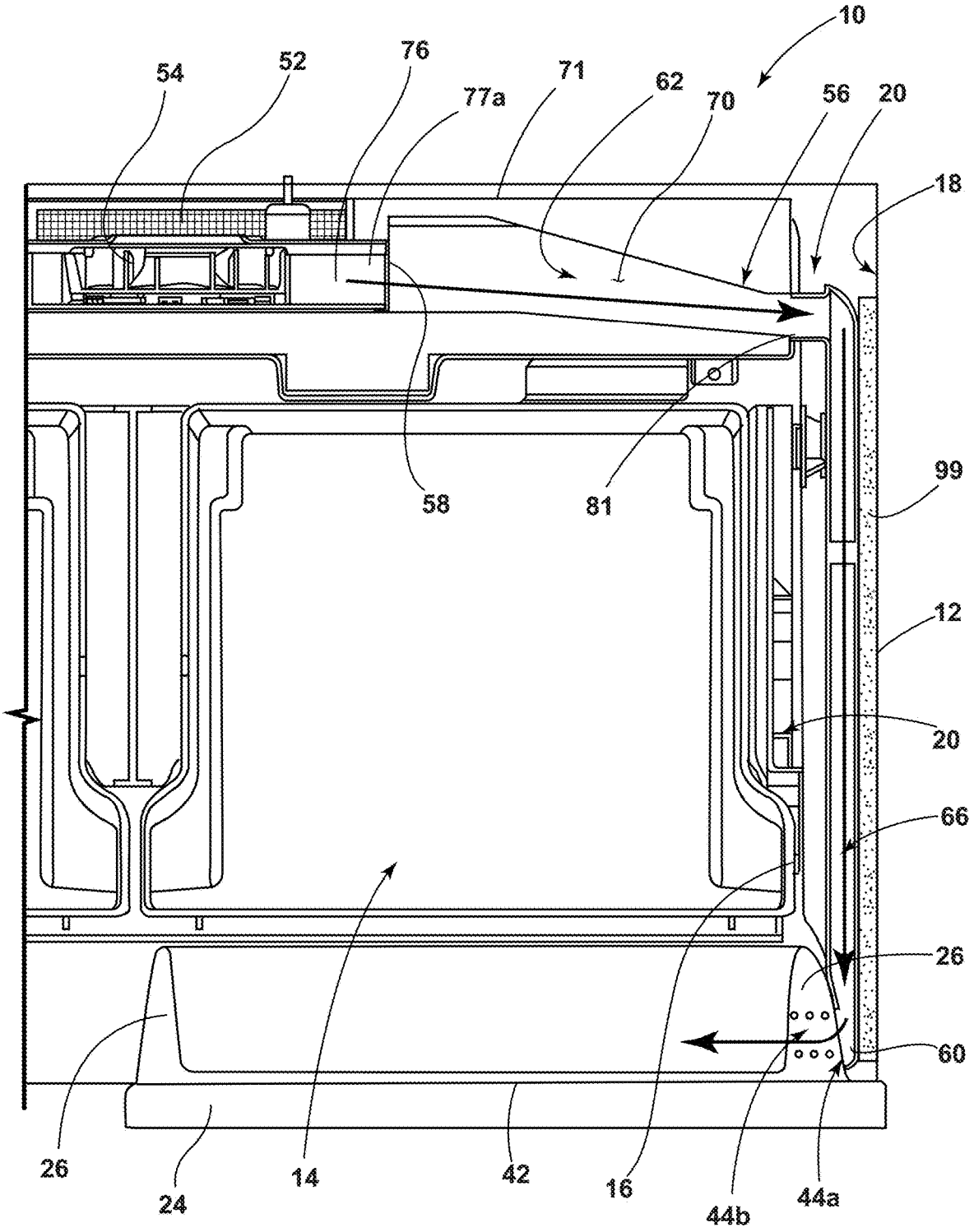
FIG. 4 is a top view of a portion of an interior of the refrigerator of FIG. 1 including the duct.

Continuing with reference to FIG. 4, it can be seen that the first portion 62 of duct 56 extends laterally outwardly through evaporator compartment 46 and liner 16 at a port 81 within sidewall 20 to position second portion 66 of duct 56 within the void 22 between the liner 16 and the wrapper 12 to extend toward the door 24. In this manner, second portion 66 of duct 56 extends forward between port 81 and vent opening 44, which may have portions 44*a* and 44*b*, respectively, in liner 16 and door dyke 28. By this arrangement, duct 56 extends through liner 16 only once, in the location of port 81, and remains within liner 16 through first portion 62, where a full layer of insulation is present between liner 16 and wrapper 12 with only second portion 66 extending on the outside of liner 16 along a relatively short distance along sidewall 20. Accordingly, such an arrangement may provide improved performance over a variation in which a similar duct extends rearward from evaporator compartment 46 and extends around the rear and side of the associated refrigerator. Second portion 66 may be a formed conduit separate from first portion 62 and sealingly engaging therewith in the location of port 81 either by a snap- or press-fit engagement between port 81 and second portion 66, by adhesive (such as glue or the like) or a seal element of foam or an elastomeric material surrounding port 81 and abutted by second portion 66. Second portion 66 of duct 56 can engage with the portion of vent opening 44*a* along liner 16, which may seal against the portion of vent opening 44*b* along door dyke 28 by way of a seal or the like such that cool air traveling through second portion 66 of duct 56 can flow through vent opening 44 into door compartment 42.

Positioning the second portion 66 of the duct 56 within void 22 can provide a relatively short path between evaporator compartment 46 and door compartment 42 so as to minimize warming of the air flowing through duct (particularly within second portion 66), as second portion 66 of duct 56 is positioned adjacent wrapper 12, which is exposed to ambient air. The minimization of cooling loss due to the short travel path may outweigh benefits provided by taking relatively longer paths through cooler portions of refrigerator 10. To further minimize cooling loss through second portion 66, second portion 66 can be made with a relatively tall, but thin cross-section, such that space is provided between second portion and 66 to maintain some insulation therebetween. In a particular example, a vacuum-insulated packet 99, including fused foil layers surrounding a filler with internal air evacuated therefrom, can be positioned between second portion 66 and wrapper 12 to provide a relatively high level of insulation given the smaller available volume.

Figure 6:
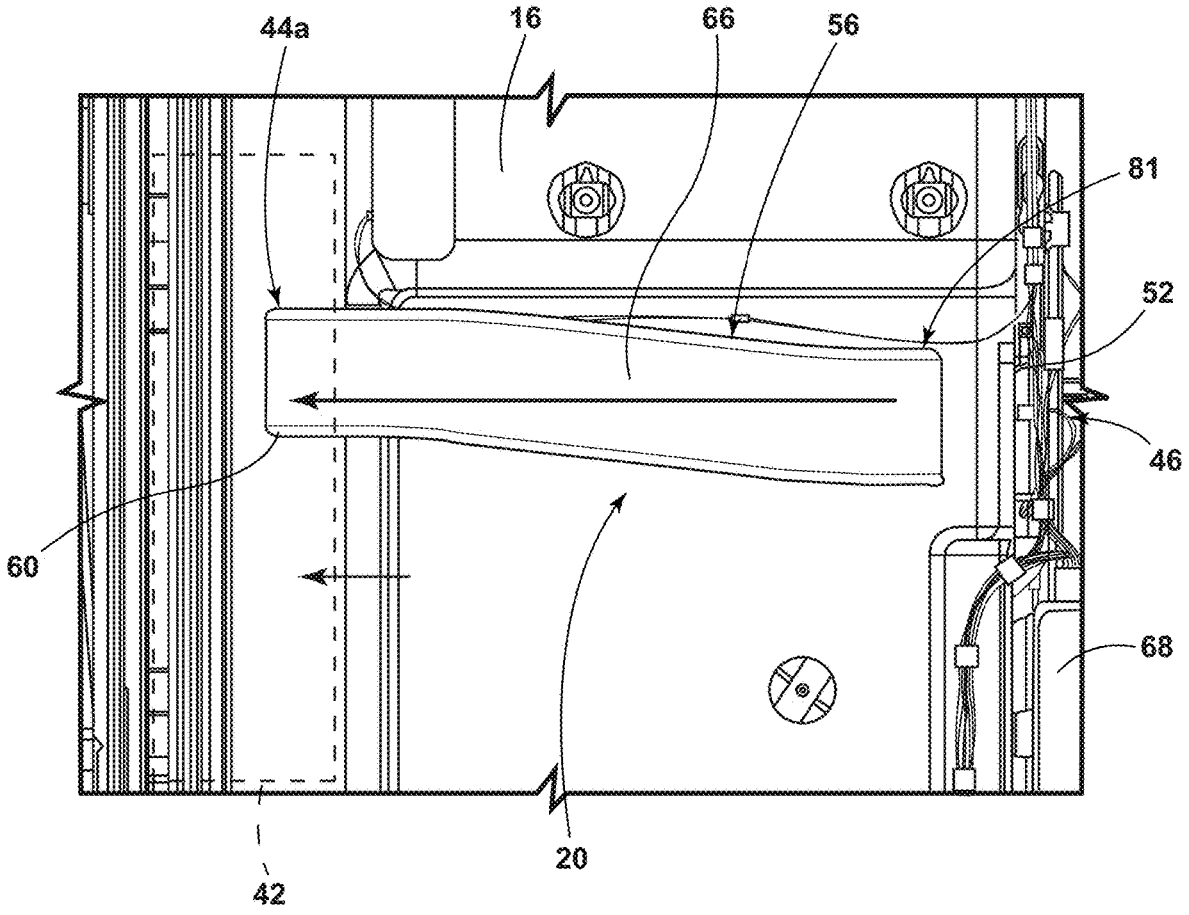
FIG. 6 is a side view of a portion of an interior of the refrigerator of FIG. 1 including a portion of the duct extending along a sidewall of an interior liner.

To promote effective cycling of the air flow provided by duct 56 through door compartment 42 and back through fresh food compartment 14 to evaporator compartment 46, the second end 44 of duct 56 and the corresponding portion of vent opening 44 in dyke 28 can be positioned vertically toward an upper portion of door compartment 42, as shown in FIG. 6. To achieve such positioning, while minimizing the length of second portion 66 of duct 56, port 81 can be positioned generally horizontal to the desired position of vent opening 44. Such positioning of vent opening 44 is such that the chilled air, which may be comparatively cooler than existing air within door compartment 42 enters door compartment 42 in the upper portion thereof, where the pressure and velocity of the air flow causes the chilled air to extend across compartment 42 away from vent opening 44. The greater density of the chilled air flowing from vent opening 44 causes the air flow to also flow downwardly. This effect in the air flow causes the chilled air to air circulate through door compartment 42 to cool door compartment 42 before settling in the lower portion thereof. Air can then exit compartment 42 from the lower portion thereof for recirculation to evaporator 52.

The present configuration of duct 56 may be particularly useful in an arrangement, as shown in FIG. 1, wherein the evaporator compartment 46 is only in communication with fresh food compartment 14 and is not used for the freezer compartment 90 also included in refrigerator 10 and defined by liner 16. In this manner, a second evaporator compartment 92 is present in connection with freezer 90 and includes a dedicated fan 104 and evaporator 106 for use in cooling freezer 90 at a relatively lower temperature than fresh food compartment 14. In a general "dual-evaporator" arrangement, the desired relative humidity level in the fresh food compartment 14 exceeds that of the freezer compartment 90, such that providing air to door compartment 42 from freezer 90 would introduce humidity into the freezer compartment 90 air flow, increasing the frost risk in the freezer compartment 90. Such an arrangement would mix the relatively warm air from the fresh food compartment 14 and relatively cold air from the freezer such that the intended behavior of each compartment could be considered as performing in an undesired manner. Still further, additional energy expenditure in such an arrangement would be required to maintain the desired temperature balance for the contents of the fresh food compartment 14, where energy margins may be small and each increment of energy use may be costly. Accordingly, the provision, in the present arrangement, of air from the evaporator compartment 46 dedicated to fresh food compartment 14 to door compartment 42, where such air then enters the fresh food compartment 14 to cool any additional items therein (which further warms the air flow) for circulation back to evaporator compartment 46 may be advantageous. The arrangement of duct 56 described herein may also be useful in a so-called "triple evaporator" arrangement, wherein a third, auxiliary compartment 94 is positioned vertically between fresh food compartment 14 and freezer compartment 90 and includes an additional dedicated evaporator 96 and fan for providing either cool or chilled air thereto. In particular, the auxiliary compartment 94 may be utilized as either a freezer compartment or a fresh food compartment, based on a user selection. Accordingly, a duct routed adjacent auxiliary compartment 94 may be subjected to significant fluctuations in temperature with, for example, changes in the utilization of auxiliary compartment 94, as well as relatively warmer temperatures, when auxiliary compartment is used for fresh food storage. In this manner, the present routing of duct 56 through sidewall 20 may offer more predictable and potentially improved performance.

It will be understood by one having ordinary skill in the art that construction of the described device and other components is not limited to any specific material. Other exemplary embodiments of the device disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the device as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present device. The exemplary structures and processes disclosed herein are for illustrative purposes and are not to be construed as limiting.

It is also to be understood that variations and modifications can be made on the aforementioned structures and methods without departing from the concepts of the present device, and further it is to be understood that such concepts are intended to be covered by the following claims unless these claims by their language expressly state otherwise.

The above description is considered that of the illustrated embodiments only. Modifications of the device will occur to those skilled in the art and to those who make or use the device. Therefore, it is understood that the embodiments shown in the drawings and described above is merely for illustrative purposes and not intended to limit the scope of the device, which is defined by the following claims as interpreted according to the principles of patent law, including the Doctrine of Equivalents.

What is claimed is:

1. A refrigerator, comprising:

an outer wrapper;

a fresh food compartment defined by a liner within the wrapper and separated from an interior of the outer wrapper at least along a first side wall of the fresh food compartment to define a void, the liner defining a port between the fresh food compartment and the void adjacent a rear wall of the liner;

a door at least partially enclosing an opening to the fresh food compartment when in a closed position, a door compartment being positioned along the door;

an evaporator compartment positioned at least partially within the fresh food compartment, and enclosed by an evaporator housing contacting the rear wall of the liner and having an interior surface defining an interior of the evaporator compartment, the evaporator housing further including a pair of spaced-apart ribs connected with the interior surface within the evaporator compartment interior, the ribs extending inwardly from and laterally along the interior surface to enclose respective upper and lower sides of a first duct portion in communication with the interior of the evaporator compartment at a first end of the first duct portion and extending laterally sideways along the interior surface toward the port, the first duct portion defining a first height at an inward lateral end thereof and widening to a second height at the port that is greater than the first height, the evaporator compartment further defining a fluid pathway having a lateral portion connecting with a downwardly-directed portion to an opening in the evaporator compartment open to a lower portion of the fresh food compartment;

a fan shroud mounted within the interior of the evaporator and enclosing a fan, the fan shroud defining an upper outlet, a first lateral outlet, and a second lateral outlet, the upper outlet being in fluid communication with an air tower within and open to the fresh food compartment, the first lateral outlet being in communication with the first duct portion, and the second lateral outlet being in communication with the fluid pathway of the evaporator compartment such that the fan is operable to draw chilled air away from the evaporator and to direct a first portion of the chilled air through the first lateral outlet and into the first duct portion, a second portion of the chilled air through the second lateral outlet and into the fluid pathway, and a third portion of the chilled air through the upper opening and into the air tower; and a second duct portion extending through the port to connect with the first duct portion at a first end thereof and in communication with the door compartment a second end thereof, the second duct portion extending through the void along the first side wall of the fresh food compartment.

2. The refrigerator of claim 1, wherein:

the door defines a door dyke extending inwardly within the fresh food compartment around a periphery of the door;

at least a portion of the dyke is adjacent to a portion of the door compartment; and a vent opening extends through the dyke and into the door compartment.

3. The refrigerator of claim 2, wherein the duct is in communication with the vent opening on a second end such that the duct directs chilled air from the evaporator compartment to the door compartment.

4. The refrigerator of claim 1, wherein:

the evaporator compartment contains an evaporator, a fan within the interior thereof, and a shroud further enclosing the fan within the interior; and the first duct portion is connected, at a first end thereof with the first lateral outlet of the shroud adjacent the fan for drawing chilled air away from the evaporator and directing a first portion of the chilled air into the first duct portion.

5. The refrigerator of claim 1, wherein the second duct portion extends horizontally through the void, the second duct portion having a height equal to the second height of the first duct portion.

6. The refrigerator of claim 1, wherein the door compartment defines an upper portion and a lower portion, the vent opening being positioned adjacent the upper portion of the door compartment, and the lower portion being open to the fresh food compartment.

7. The refrigerator of claim 4, wherein the third portion of the chilled air from the evaporator compartment to is directed through the air tower and into the fresh food compartment.

8. The refrigerator of claim 7, wherein the evaporator compartment is a first evaporator compartment in communication with the fresh food compartment and the door compartment only and the evaporator is a first evaporator.

9. The refrigerator of claim 8, further including:

a freezer compartment defined by the liner; and a second evaporator compartment positioned adjacent the freezer compartment and containing a second evaporator, the second evaporator compartment being in fluid communication with the freezer compartment.

10. The refrigerator of claim 9, further including:

an auxiliary compartment defined by the liner and vertically disposed between the fresh food compartment and the freezer compartment; and a third evaporator compartment positioned adjacent the freezer compartment and containing a third evaporator, the third evaporator compartment being in fluid communication with the auxiliary compartment.

11. The refrigerator of claim 1, further comprising a vacuum-insulated layer extending at least partially along the second portion of the duct between the duct and the wrapper.

12. The refrigerator of claim 1, wherein the pair of spaced-apart ribs are formed on the evaporator housing so as to be directly joined thereto.

13. A refrigerator, comprising:

an outer wrapper;

a fresh food compartment defined by a liner within the wrapper and separated from an interior of the outer wrapper at least along a first side wall of the fresh food compartment to define a void, the liner defining a port between the fresh food compartment and the void adjacent a rear wall of the liner;

a door at least partially enclosing an opening to a fresh food compartment when in a closed position, a door compartment being positioned along the door;

an evaporator compartment positioned at least partially within the fresh food compartment and enclosed by an evaporator housing contacting the rear wall of the liner and having an interior surface defining an interior of the evaporator compartment, the evaporator housing further including a pair of spaced-apart ribs connected with the interior surface within the evaporator compartment interior, the ribs extending inwardly from and laterally along the surface to enclose respective upper and lower sides of a first duct portion by contacting the rear wall of the liner such that a portion of the rear wall of the liner between the ribs defines a rear side of the first duct portion, the first duct portion extending laterally sideways along the interior surface toward the port, an upper one of the pair of spaced-apart ribs extending horizontally along the surface in a planar arrangement and a lower one of the pair of spaced-apart ribs having a first portion extending parallel with the upper one of the pair of spaced-apart ribs and a second portion extending away therefrom in a vertical direction while extending laterally toward the port, the evaporator compartment further defining a fluid pathway having a lateral portion connecting with a downwardly-directed portion to an opening in the evaporator compartment open to a lower portion of the fresh food compartment;

a shroud enclosing a fan within the interior of the evaporator compartment and defining a first lateral outlet, the first duct portion being connected with the first lateral outlet of the shroud, a second lateral outlet in communication with the fluid pathway of the evaporator, and an upper outlet being in fluid communication with an air tower within and open to the fresh food compartment, that the fan being operable to draw chilled air away from the evaporator and to direct a first portion of the chilled air through the first lateral outlet, a second portion of the chilled air through the second lateral outlet, and a third portion of the chilled air through the upper opening; and a second duct portion in fluid communication through the port with first duct portion at a first end thereof and in communication with the door compartment a second end thereof, the second duct portion extending from the first duct portion toward the opening of the fresh food compartment.

14. The refrigerator of claim 13, further defining:

an outer wrapper;

the liner being disposed within the wrapper and separated from an interior of the outer wrapper at least along a first side wall of the fresh food compartment to define a void, wherein:

the port is open to the void; and the second portion of the duct extends horizontally through the void along the first side wall of the fresh food compartment.

15. The refrigerator of claim 13, wherein:

the door defines a door dyke extending inwardly within the fresh food compartment around a periphery of the door;

at least a portion of the dyke is adjacent to a portion of the door compartment;

a vent opening extends through the dyke and into the door compartment; and the duct is in communication with the vent opening on a second end such that the duct directs chilled air from the evaporator compartment to the door compartment.

16. The refrigerator of claim 13, wherein:

the first portion of chilled air is drawn away from the evaporator by the fan and directed through the first lateral outlet of the shroud into the first duct portion; and the air tower is connected with the upper outlet of the shroud adjacent the fan for providing the third portion of chilled air from the evaporator to the fresh food compartment.

17. The refrigerator of claim 16, wherein the evaporator compartment is a first evaporator compartment in communication with the fresh food compartment and the first duct portion only, and the evaporator is a first evaporator.

18. The refrigerator of claim 17, further including:

a freezer compartment defined by the liner; and a second evaporator compartment positioned adjacent the freezer compartment and containing a second evaporator, the second evaporator compartment being in fluid communication with the freezer compartment.

19. The refrigerator of claim 18, further including:

an auxiliary compartment defined by the liner and vertically disposed between the fresh food compartment and the freezer compartment; and a third evaporator compartment positioned adjacent the freezer compartment and containing a third evaporator, the third evaporator compartment being in fluid communication with the auxiliary compartment.

20. A refrigerator, comprising:

an outer wrapper;

a fresh food compartment defined by a liner within the wrapper and separated from an interior of the outer wrapper at least along a first side wall of the fresh food compartment to define a void, the liner defining a port between the fresh food compartment and the void adjacent a rear wall of the liner;

a door at least partially enclosing an opening to the fresh food compartment when in a closed position, a door compartment being positioned along the door;

an evaporator compartment positioned at least partially within the fresh food compartment and enclosed by an evaporator housing contacting the rear wall of the liner and having an interior surface defining an interior of the evaporator compartment, the evaporator housing further including a pair of spaced-apart ribs extending inwardly from the interior surface within the evaporator compartment interior to define a first duct portion with a portion of the interior surface between the ribs, the first duct portion being in communication with the interior of the evaporator compartment and extending laterally sideways along the surface toward the port, an upper one of the pair of spaced-apart ribs extending horizontally along the interior surface in a planar arrangement and a lower one of the pair of spaced-apart ribs having a first portion extending parallel with the upper one of the pair of spaced-apart ribs and a second portion extending away therefrom in a vertical direction while extending laterally toward the port, the evaporator compartment further defining a fluid pathway having a lateral portion connecting with a downwardly-directed portion to an opening in the evaporator compartment open to a lower portion of the fresh food compartment;

a fan shroud mounted within the interior of the evaporator and enclosing a fan, the fan shroud defining an upper outlet, a first lateral outlet, and a second lateral outlet, the upper outlet being in fluid communication with an air tower within and open to the fresh food compartment, the first lateral outlet being in communication with the first duct portion, and the second lateral outlet being in communication with the fluid pathway of the evaporator compartment such that the fan is operable to draw chilled air away from the evaporator and to direct a first portion of the chilled air through the first lateral outlet and into the first duct portion, a second portion of the chilled air through the second lateral outlet and into the fluid pathway, and a third portion of the chilled air through the upper opening and into the air tower;

a second duct portion in fluid communication through the port with the first duct portion at a first end of the second duct and in communication with the door compartment a second end of the second duct, the second duct portion extending through the void along the first side wall of the fresh food compartment; and a vacuum-insulated layer extending at least partially along the portion of the duct between the duct and the wrapper.

* * * * *